United States Patent [19]

Lejars et al.

[11] Patent Number: 4,732,536

[45] Date of Patent: Mar. 22, 1988

[54] TURBO-MACHINE COMPRESSOR WITH VARIABLE INCIDENCE STATOR VANES

[75] Inventors: Claude R. L. Lejars, Draveil; Jacky Naudet, Bondoufle; Jean-Max M. Silhouette, Melun; Stenneler, Le Chatelet En Brie, all of France

[73] Assignee: Societe Nationale d'Etude et de Construction de Moteurs d'Aviation "S.N.E.C.M.A.", Paris, France

[21] Appl. No.: 875,684

[22] Filed: Jun. 18, 1986

[30] Foreign Application Priority Data

Jun. 20, 1985 [FR] France ..... 85 09360

[51] Int. Cl.[4] ..... F04D 29/56

[52] U.S. Cl. ..... 415/160; 415/9

[58] Field of Search ..... 415/9, 148, 150, 159, 415/160–164

[56] References Cited

U.S. PATENT DOCUMENTS 2,862,357 12/1958 Haworth et al. ..... 415/160 X
4,040,766 8/1977 Sekido et al. ..... 415/9
4,210,408 7/1980 Nace ..... 415/160 X
4,231,703 11/1980 Weiler ..... 415/160 X

FOREIGN PATENT DOCUMENTS 1325261 3/1963 France .
1548701 10/1967 France .
2524934 10/1983 France .
1324385 7/1973 United Kingdom .

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

A turbo-machine compressor which includes variable incidence stator vanes the angular adjustment of which is controlled by a control ring coupled to individual vanes by individual links. Each link has at least one contact surface on each of its longitudinal edges, such surfaces being either plane or convex. In the event of failure of any link, the change in orientation is controlled within narrow limits by contact with the contact surfaces of adjacent links which have not failed.

12 Claims, 14 Drawing Figures

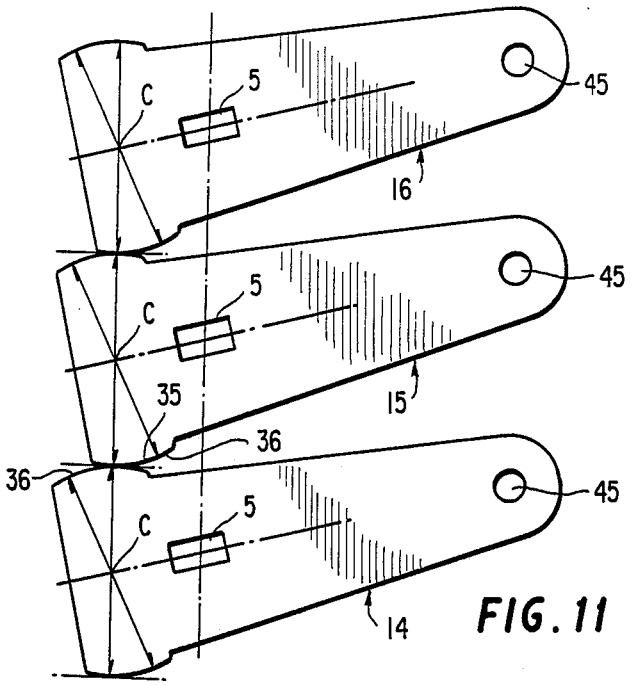
FIG. 11
FIG. 9
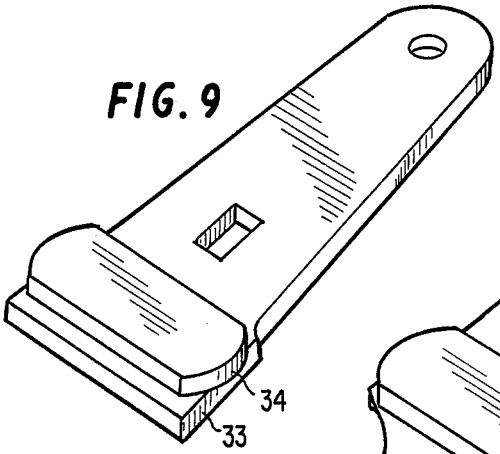
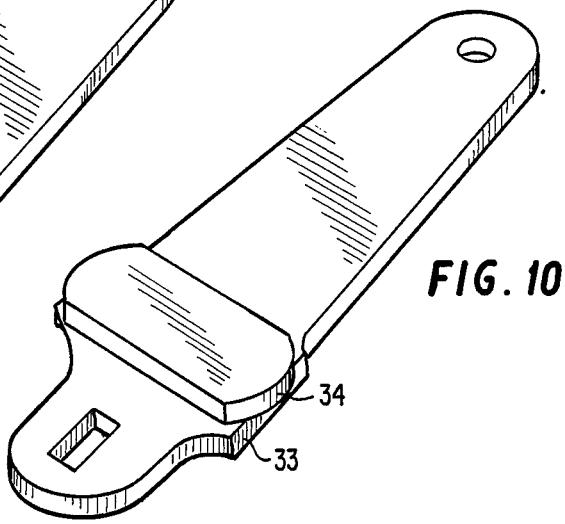
FIG. 10

TURBO-MACHINE COMPRESSOR WITH VARIABLE INCIDENCE STATOR VANES

BACKGROUND OF THE INVENTION

1. Field of the Invention

The invention relates to a turbo-machine compressor, more particularly a linkage for controlling the angles of incidence of the stator vane of the compressor.

2. Description of the Prior Art

The adjustment of the orientation of stator vanes of one or more stages of the compressor of a turbo-machine at a given rating is generally effected through the intermediary of links which are secured at one end thereof to a vane pivot whilst a second end thereof is pivotally connected on a ring capable of turning under the action of a drive device controlled by the regulatory system of the engine.

Fracture of a link gives rise to oscillation of the vane in question and consequently an adverse effect upon the aerodynamic efficiency of the compressor. Furthermore, in current advanced engines, the orientation of the vanes is calculated so as to reduce by a maximum amount the length of the compressor and because of this one vane deprived of its orientation control is liable to contact the rotor, giving rise to serious damage, even before reaching its oscillating condition.

Attempts have therefore been made to devise a security device limiting the amplitude of the accidental change in orientation of the vane.

Thus French Patent No. 2 524 934 describes a security device for a vne controlled at the tip, an arm secured to the root pivot and capable of turning through a limited angular range in a recess provided in the inner supporting the bearings of the root pivots.

Such a device only enables the "wild" vane to lock itself in two end orientations, defined by the abutment of the arm against the walls of a recess, independent of the orientation of the other vanes, and requires a substantial modification to the inner ring and to the root pivots.

According to another prior proposal, described in French Patent Specification No. 1 325 261, the vanes have platforms both at the tip and the root. These platforms are approximately circular but have two diametrically opposed flats. The platforms are mounted in casings so that the flats of two adjacent vanes leave a space enabling pivoting of vanes between two angular end orientations. The device serves to prevent or at least to minimize gas losses between the platforms in the two angular end orientations and it is not effective insofar as losses can arise at intermediate angular positions.

Similar devices having the same function are described for example in French Patent Specification No. 1 548 701 and British Patent Specification No. 1 324 385.

Such devices are capable of limiting the rotation of a vane in the case of failure of its control mechanism. However, they are bulky and require a substantial modification to the stator so as to receive the platforms. Furthermore, given the small dimensions necessary for the flats, they are not capable of controlling effectively a vane in an angular end orientation in relation to another in case of failure of the control link, and because of thus they give rise to undesirable friction and jamming.

SUMMARY OF THE INVENTION

One object of the present invention is the construction of a security device applicable to vanes controlled by links, without necessitating modification other than that of the links themselves and providing a redundant control means associated substantially with the released vane.

According to the present invention there is provided in a turbo-machine compressor, an array of variable incidence stator vanes, each vane having first pivot means at a first end thereof by which the vane is mounted for variable orientation, and second pivot means at a second end thereof, and means for varying the incidence of the vanes including a plurality of links, each such link being connected at a first end portion thereof to the second pivot means of a respective vane, and a ring member on which the second end portions of the links are pivotally connected so that motion of the ring member about the longitudinal axis of the compressor results in simultaneous adjustment of the stator vanes, each longitudinal side of each link being formed with a contact surface of which the generating line is substantially parallel to the axis of the second pivot means, the contact surfaces of adjacent links being so disposed that in the event of failure of one of said links, the contact surface of that link will make contact with the contact surface of an adjacent link thereby limiting the change in incidence of the vane connected with the failed link.

In practice, all the links described herein effect simultaneously the end control function of the corresponding vane and the function of preventing impact of this vane when it is accidentally released from control. Now these two functions may also be carried out separately, the link maintaining its initial control function of the vane whilst a special plate, superposed on the link and connected to the pivot of the vane in the same manner as the link, effects only the function of abutment described herein. This modification will not be described in further detail as it will be understood readily from the description which follows.

BRIEF DESCRIPTION OF THE DRAWINGS

FIG. 9 is a perspective view of one embodiment of a link as illustrated in FIG. 8;

FIG. 10 is a perspective view of another embodiment of a link similar to that of FIG. 8;

FIG. 11 is a development showing a group of three links according to another embodiment in a position at the end of their adjustment travel;

DESCRIPTION OF THE PREFERRED EMBODIMENTS

Figure 1:
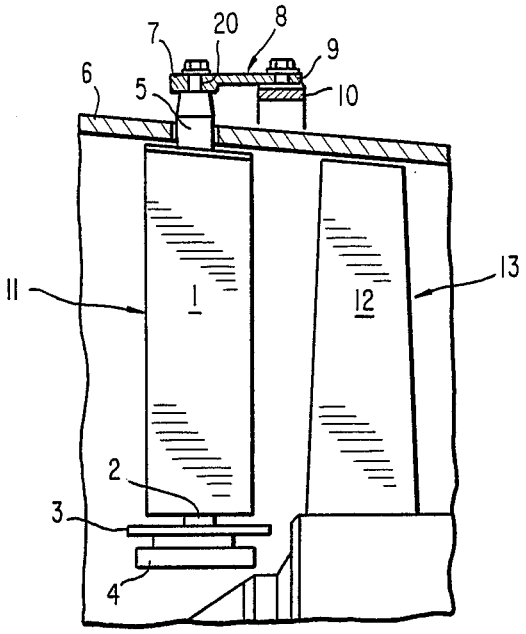
FIG. 1 illustrates, as a diagrammatic fragmentary view, one stage of a compressor with variable incidence stator vanes.

The fragmentary diagrammatic view in section of a part of one stage of the compressor of a turbo-machine (FIG. 1) illustrates a stator vane 1 having variable incidence comprising a root pivot 2 which can turn in a bearing 3 located in an an inner ring 4, and having a tip pivot 5 which traverses the casing 6 of the compressor through a bearing. A link 8 is secured at one of its end portions 7 to an end portion of the pivot and the other end portion 9 of the link is pivoted on a control ring 10.

The vanes 1 serve as the stator vanes 11 which distribute the air flow to the blades 12 of the rotor 13 disposed downstream thereof.

Rotation of the control ring 10 enables adjustment of the orientation of the vanes 1 to a desired angle, dependent upon the rating of the engine at any given instant.

All the Figures hereinafter described are fragmentary views from a radially outwards location illustrating the rods or links in a common plane i.e. developments, each link, pivoting about a respective pivot 5 of which the axes are perpendicular to this plane. When incorporated in a turbo-machine, the rods or links 8 are disposed on a cylinder or large radius circumscribing the casing 6 of the compressor and the axes of the pivots converge towards the axes of the turbo-machine defining between adjacent vanes a very small angle. This necessitates a slight adaptation of the surfaces which will be described in order to improve the quality of their contacts. These modifications are easily carried out by one skilled in the art, although not indispensible. Further reference will not be made during the course of the description which follows the surfaces will be considered in relation to the projection plane.

Similarly, all the Figures viewed from a radially outer location hereinafter described represent symmetrical rods or links with respect to a longitudinal median plane XX' which contains the axis 0 of the pivot 5 and the axes 45 for the pivoting of the links on the ring 10. This symmetry is in no way indispensable and further reference will not be made in the following description of assymetric possibilities. Rods or links carrying out similar functions in the same fashion can be made with different shapes without departing from the scope of the claims.

Figure 2:
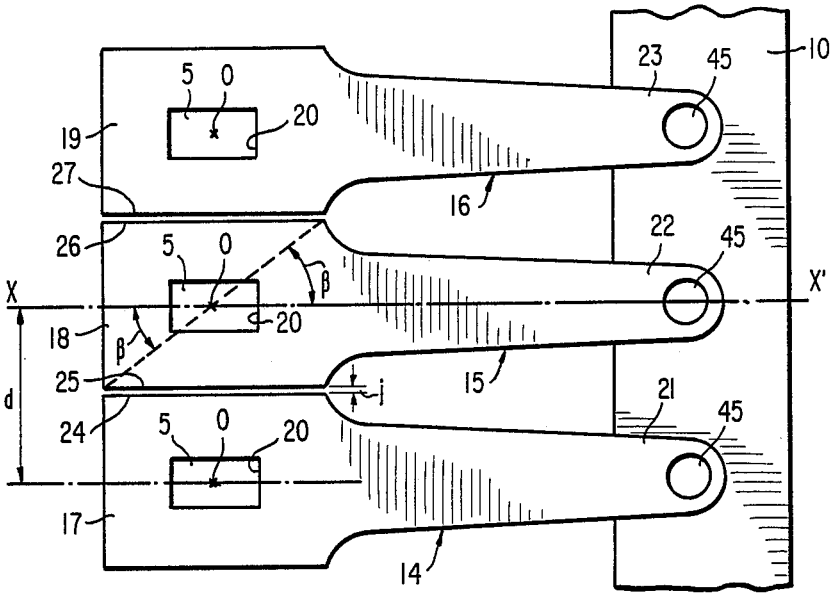
FIG. 2 is a development, to an enlarged scale, of FIG. 1 illustrating one embodiment of a link in accordance with the invention

FIG. 2 illustrates a group of links 14,15,16, in accordance with one embodiment of the invention of which one end portion 17,18,19 includes means for securing them to the pivots 5 of the vanes 1. The securing means are constituted by a polygonal aperture 20 which cooperates with corresponding flats machined on the end portion of the tip pivots 5 of the vanes 1.

The other end portions 21,22,23 are pivoted on pins 45 on the control ring 10 thus ensuring synchronization of the angular displacements of the array of vanes 1 of the stator.

The links have, on each of their longitudinal sides, a plane contact surface which is parallel to the median longitudinal plane XX' arranged to cooperate at least at a limited generating line with a similar contact surface of the adjacent side of the adjacent link.

In the embodiment illustrated in FIG. 2, the end portions 17,18,19 of the links have a parallelepiped rectangular shape centered longitudinally with respect to the axis 0 of the vane pivot, which is also the axis of rotation of the link. The longitudinal sides, for example sides 25 and 26, of the central linkage of the group illustrated constitute plane contact surfaces parallel to the longiutindal median plane XX'. When the links have their longitudinal median planes XX' approximately perpendicular to the plane of the ring 10, as illustrated here, their contact surfaces are separated from their adjacent ones by clearances j enabling their rotation through a given angle in one direction or the other.

Figure 3:
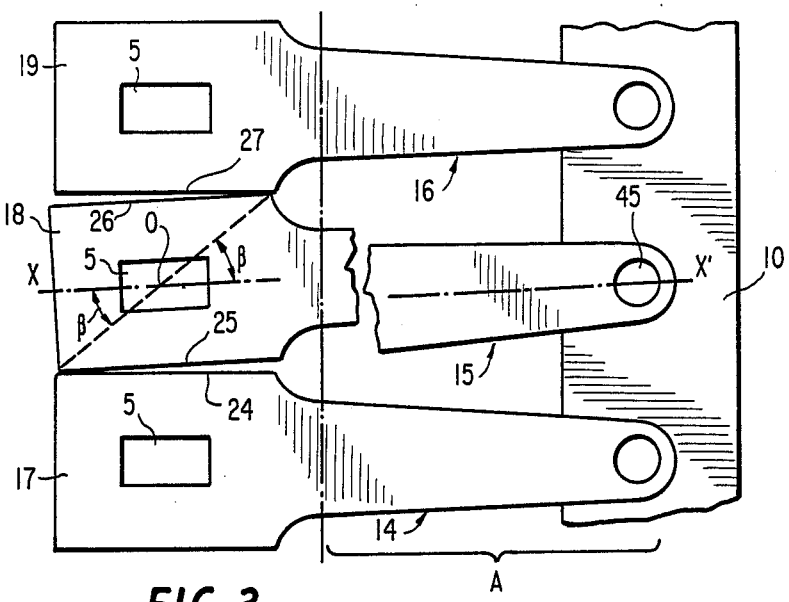
FIG. 3 is a view identical to that of FIG. 2 but in which one link is broken.

FIG. 3 illustrates, for the same group of links in the same orientation as that of FIG. 2, the restraining action of the end portion 18 of the central link 15 which is released. The fracture of a link which occurs generally in the zone A lying between the end portion 17,18,19 comprising the means for securing to the pivot 5 of the vane and the axis 45 pivoting to the ring 10, this zone being the weakest and the most highly loaded.

The contact surfaces, formed by the sides 25,26 of the end portion 18 of the link 15 which has been released, come into abutment respectively against the contact surfaces constituted by the sides 24,27 of the adjacent links 14,16 on at least two symmetrical generating lines with respect to the axis 0 of the vane pivot, which limits the possible change in angular orientation of the released vane 1.

Figure 4:
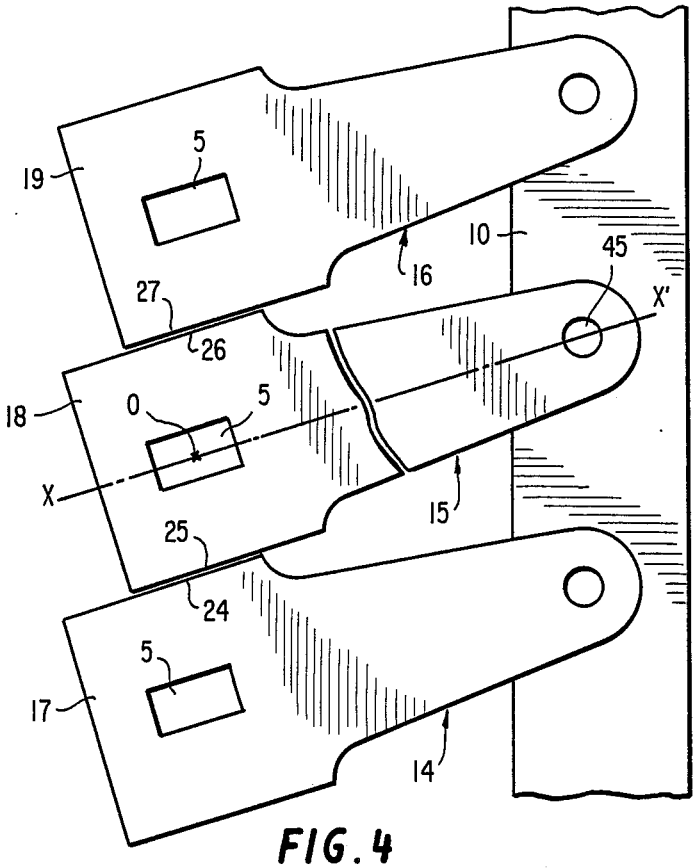
FIG. 4 is a view identical to that of FIG. 3 but in which the links are adjusted to one end orientation.

FIG. 4 illustrates the retention of a released blade by two adjacent blades when in an orientation at the end of the range of movement. The contact then takes place over almost the entire length of the adjacent plane contact surfaces 25,24 and 26,27.

The links illustrated in FIGS. 2 to 4 are more particularly intended to be used in "very compact" engines, that is to say of very short length. The dimensions impose, simultaneously an angular orientation of the vanes (from 10° to 20° according to the stages) and links of reduced length, from whence an orientation of the center of rotation of the vane is substantially aligned with the middles of the sides forming the contact surfaces.

The contact surfaces enable, in the case of failure of a link, and for an adjustment control of the "all or nothing" a type re-assertion of control of the "released" vane even to the end of the range adjustment of adjacent links, whatever the sense of the control movement. The maximum angle of incidence correspond to abutment conditions on one or the other of the two adjacent contact surfaces, for example 24 and 25, of two adjacent links. This angle is a function of the distance d separating the axes 0 of two adjacent links and of the initial clearance j separating the two adjacent contact surfaces in the median position of the links.

If the control orientation is adjusted, the released vane is only immobilized in the end positions of the links which are still controlled. In intermediate orientations, the clearances j between the contact surfaces do not permit turning except within limits defined by the position of the links which are still controlled. For a common spacing d between the axes 0 of the two adjacent links and a common initial clearance j between the adjacent contact surfaces, the angular change in setting of the vane will be smaller than the angle $\beta$, formed between the longitudinal median plane XX' of the link and the limiting generating line of the contact surface which brings the first one into contact with the adjacent surface, will be the smaller. Furthermore, the contact pressure on the contact surface of the released vane on the adjacent surface, the control force to be applied by the surface of the vane still controlled on the surface of the released adjacent vane, and the risk of jamming will be the smaller as the angle $\beta$ becomes smaller.

Figure 5:
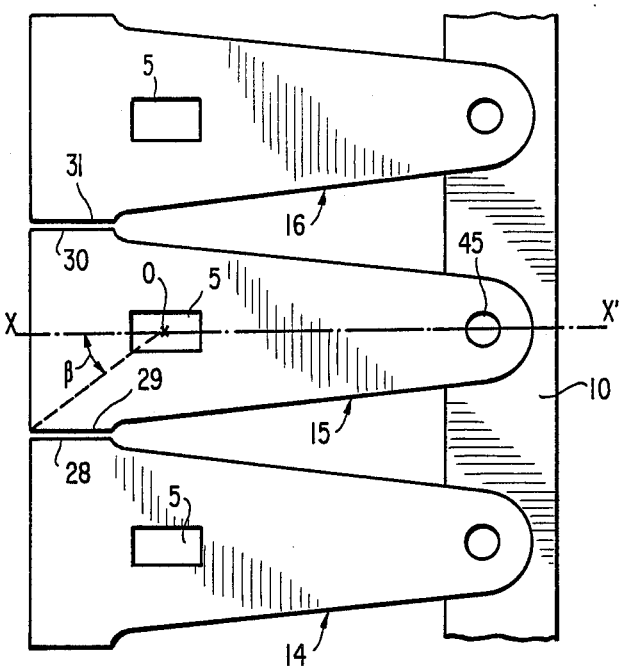
FIGS. 5 to 8 illustrate various embodiments of the links in accordance with the invention.
Figure 6:
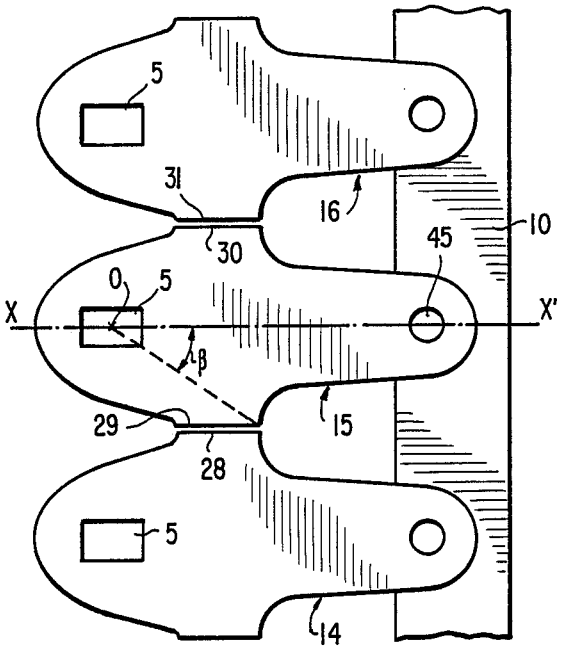

FIGS. 5 and 6 illustrate two novel embodiments of links in accordance with the invention in which the contact surfaces are plane, parallel, symmetrical with respect to the median longitudinal plane XX' of the link, and spaced from the axis 0 of the blade pivot in the longitudinal direction XX'.

In the embodiment of FIG. 5, the contact surfaces, for example surfaces 29,30, of the central link 15 are spaced towards the end of the link with the securing means to the pivot 5, beyond the axis 0 of the vane pivot.

The mode of operation of the contact surfaces of the links adjacent to the released link is in all ways similar to that of the embodiments hereinbefore described.

This embodiment has the advantage of permitting angles $\beta$ which are much smaller but the disadvantage of extending the length of the links. The embodiment illustrated in FIG. 6 enables this disadvantage to be overcome while benefiting from the same common advantage and being of lower weight. The contact surfaces are placed between the axis 0 of the plane pivot and the axis of rotation 45 of the link on the ring 10.

Figure 7:
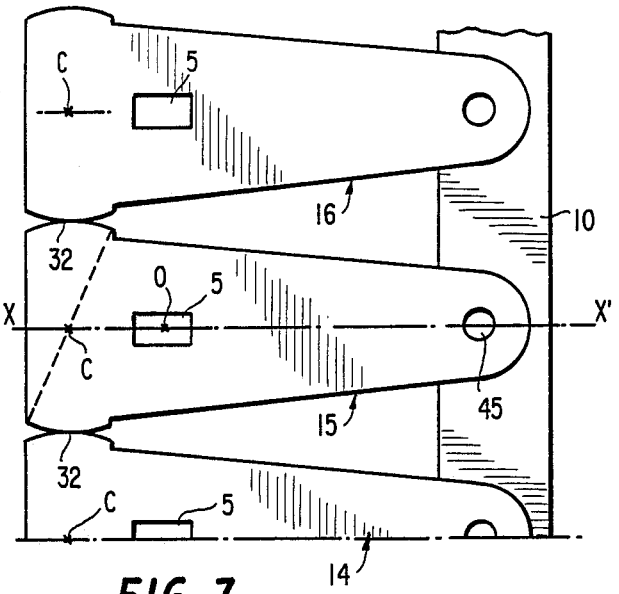

The modification illustrated in FIG. 7 is similar to that of FIG. 5, except that the plane contact surfaces have been replaced by cylindrical convex surfaces. This arrangement enables a reduction in or even omission of the clearance j between two links, and thus the angular loss of setting of a released link in intermediate positions.

The cylindrical surfaces are formed by two sectors of a common circular cylinder of which the axis C is parallel to the axis O of pivoting of the blade, placed in the longitudinal median plane XX' of the link and offset with respect to the axis of rotation O of the link beyond axis O.

When the links pivot about the axes 0, the cylindrical surfaces 32 slide one within the other. As a result of the conditions of use of the links, it is not sought to achieve zero clearance by a minimum clearance and thus the angular change is reduced for a released vane to a fraction of a degree on either side of the orientation which it is intended to occupy.

According to a non-illustrated embodiment, but similar to that of FIG. 6, the contact surfaces are placed between the axis O of rotation of the link and the axis 45 of the pivotal connection on the ring 10 and have a cylindrical shape similar to that of FIG. 7.

In the two latter modifications, the effect of abutment of the links on one another at the ends of the stroke, as illustrated in FIG. 4, is no longer effected only by a cylindrical surfaces. The embodiments which follow show how it is possible to retain this action.

Figure 8:
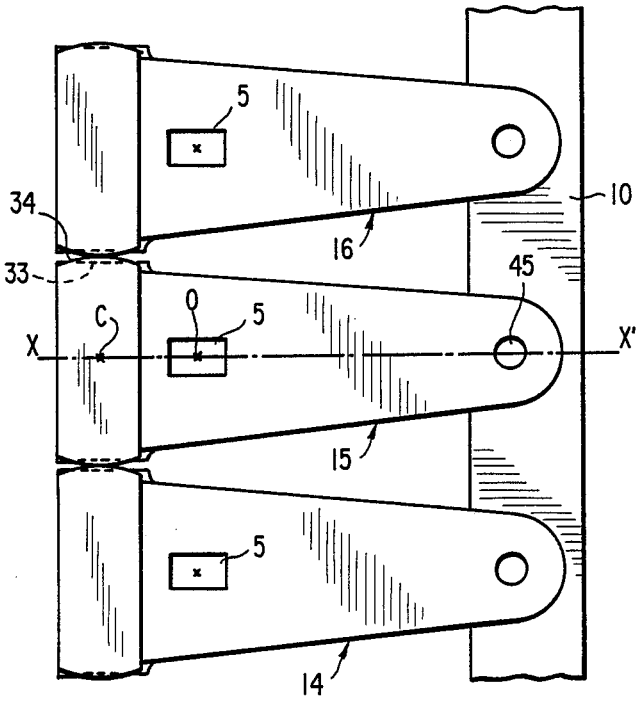

FIG. 8 illustrates an embodiment produced by a superposing in the axial sense, that is to say in the direction of the thickness of the link, the plane contact surface 33 and the cylindrical contact surface 34, the plane of the plane surface being a secant of the cylindrical surface.

The adjacent plane surfaces 33 of two adjacent links are thus spaced from one another, so that they come into contact with one another when the links are in the positions at the ends of their range while the cylindrical surfaces 34 are always in contact on one of their generating lines or very close thereto and ensure the retention of the released vane in intermediate orientations.

The contact surfaces liable to become effective are thus constituted by a cylindrical surface extended at its ends by a plane surface parallel to the longitudinal median plane XX' of the link.

FIGS. 9 and 10 show in perspective two embodiments of links such as hereinbefore described. The cylindrical surfaces are herein produced with the aid of a circular member of which only the median useful part is retained, connected and secured in known manner on the flats 33.

Figure 12:
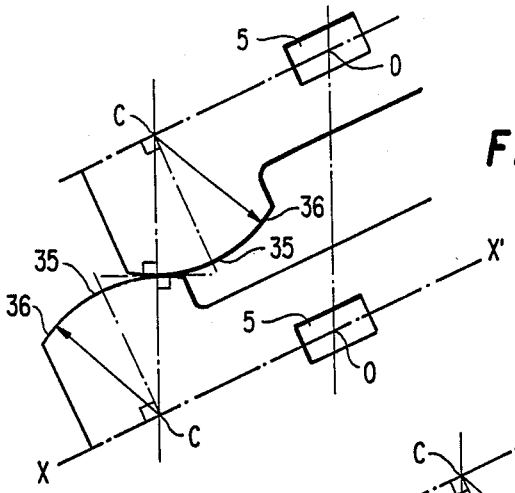
FIG. 12 is a view, to an enlarged scale, of contact surfaces incorporated in the embodiment illustrated in FIG. 11.
Figure 13:
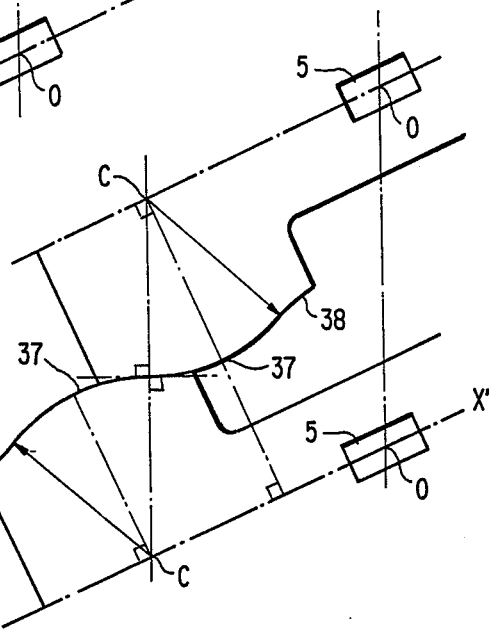
FIG. 13 is a view, to an enlarged scale, of contact surfaces of the links incorporated in yet another embodiment.

FIG. 11 illustrates a group of three links of which the contact surfaces are formed by a central cylindrical part 35 extended at its two ends by a plane surface 36 tangential to the cylindrical surface at its merging point. The plane surfaces serve as abutments for the ends of the range on the cylindrical surfaces of two adjacent links. The method of operation is readily understood by referring to FIG. 12 which is in an enlarged scale. In practice, any volume external to the cylindrical surfaces proposed in FIG. 7 prevents the links in contact from pivoting while maintaining their parallel relationship and stopping an angular change in setting. The same principle is again taken up in FIG. 13 which illustrates another embodiment in which the convex central cylindrical surface 37 is extended by a concave and tangential cylindrical surface 38 of the same radius as the central convex part 37.

Figure 14:
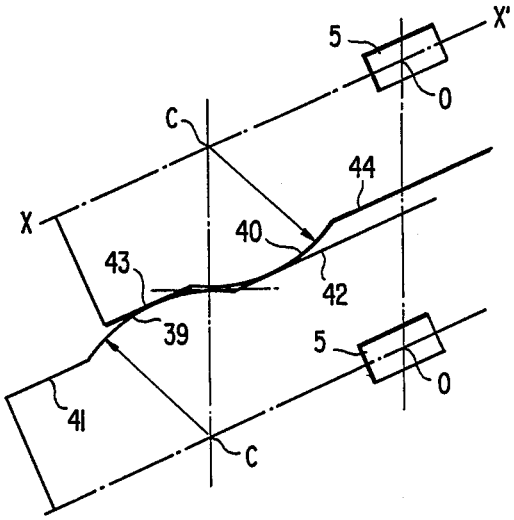
FIG. 14 is a side view, to an enlarged scale, of contact surfaces of links incorporated in yet another embodiment.

FIG. 14 illustrates another embodiment of the links in which the adjacent sides have convex cylindrical surfaces 39,40 extended respectively on either side of by plane non-tangential surfaces 41,42,43,44 parallel to the longitudinal median plane XX', so that in the position of the end of the adjustment range illustrated, the cylindrical surfaces 39 and 40 respectively support themselves on the plane surfaces 43 and 42.

As in the embodiments hereinbefore described, the contact surfaces can also be disposed between the axis of rotation 0 of the vane and the pivotal connection axis 45 of the link to the control ring 10.

In order to simplify manufacture, it is possible to provide only one abutment or contact surface described in FIGS. 11 to 14 on each side of the links.

The contact system produced by the provision of at least one surface of curvature different from the convex cylindrical surface is particularly useful when several consecutive links are broken or otherwise detached from the control ring. In practice, in this case, the clearance or angular adjustments of the released blades are liable to increase from the first vane to the last, and without this system, the last vanes are liable to take up impermissible angular orientation.

Obviously, numerous modifications and variations of the present invention are possible in light of the above teachings. It is therefore to be understood that within the scope of the appended claims, the invention may be practiced otherwise than as specifically described herein.

What is claimed is:

1. In a turbo-machine compressor, an array of variable incidence stator vanes, each vane having;

first pivot means at a first end by which the vane is mounted for variable orientation, and second pivot means at a second end, and means for varying the incidence of the vanes including a plurality of links, each such link being connected at a first end portion thereof to the second pivot means of a respective vane, and a ring member on which a second end portion of the links are pivotally connected so that motion of the ring member about the longitudinal axis of the compressor results in simultaneous adjustment of the stator vanes, each longitudinal side of the link being formed with a contact surface substantially parallel to the axis of the second pivot means, and the contact surfaces of adjacent links being so disposed that in the event of failure of one said link the contact surface of that link will make contact with the contact surface of an adjacent link thereby limiting the change in incidence of the vane connected with the failed link.

2. A turbo-machine compressor according to claim 1, wherein the contact surfaces of each link are substantially planar, extend parallel to a longitudinal plane of the link and are longitudinally centered with respect to the axis of the second pivot means.

3. A turbo-machine compressor according to claim 1, wherein the contact surfaces of each link are substantially planar, extend parallel to a longitudinal plane of the link, and are spaced longitudinally from the axis of the second pivot means.

4. A turbo-machine compressor according to claim 3, wherein the contact surfaces of each link are located on the side of the second pivot means remote from the ring member.

5. A turbo-machine compressor according to claim 3, wherein the contact surfaces are located between the axis of the second pivot means and the end portion of the link pivotally connected to the ring member.

6. A turbo-machine compressor according to claim 1, wherein the contact surfaces are at least in part of substantially convex cylindrical form.

7. A turbo-machine compressor according to claim 6 wherein the convex cylindrical surfaces are defined by two sectors of a common cylinder the axis of which is parallel to the axis of rotation of the second pivot means.

8. A turbo-machine compressor according to claim 6 wherein the cylindrical contact surfaces are superposed, in the radial sense of the compressor stage, on plane contact surfaces, the plane containing the plane surface being the secant of the cylindrical surface and parallel to the axis of rotation of the second pivot means.

9. A turbo-machine compressor according to claim 6 wherein the cylindrical convex contact surfaces are extended at at least one of their ends by a plane surface tangential to the cylindrical surface at its merging line.

10. A turbo-machine compressor according to claim 6 wherein the cylindrical convex contact surfaces are connected to at least one of their ends to a concave cylindrical surface of the same radius and tangential to the convex cylindrical surface at the merging line.

11. A turbo-machine compressor according to claim 6 wherein the cylindrical convex contact surfaces are extended at at least one of their ends by a plane contact surface parallel to the axis of rotation of the second pivot means.

12. A turbo-machine compressor according to claim 1, wherein each link comprises two independent parts, the first providing a control function for the vane in accordance with a known form, the second, superposed on the first and connected to the second pivot means in the same manner, providing an angular abutment function of the vane in the case of failure of the first part.

* * * * *

UNITED STATES PATENT AND TRADEMARK OFFICE

CERTIFICATE OF CORRECTION

PATENT NO. : 4,732,536

DATED : Mar. 22, 1988

INVENTOR(S) : Claude R. L. Lejars, et al.

It is certified that error appears in the above-identified patent and that said Letters Patent is hereby corrected as shown below:

The name of the fourth inventor is incomplete on the Letters Patent. His full name is Jacques M. P. Stenneler.

Signed and Sealed this

Eleventh Day of October, 1988

*Attest:*

DONALD J. QUIGG

*Attesting Officer*

*Commissioner of Patents and Trademarks*